US008469188B1

(12) United States Patent
Vitale

(10) Patent No.: US 8,469,188 B1
(45) Date of Patent: Jun. 25, 2013

(54) CAULK "BUDDY" ORGANIZER CADDY

(76) Inventor: John Jasper Vitale, St. Louis, MO (US)

( * ) Notice: Subject to any disclaimer, the term of this patent is extended or adjusted under 35 U.S.C. 154(b) by 52 days.

(21) Appl. No.: 13/083,058

(22) Filed: Apr. 8, 2011

Related U.S. Application Data

(60) Provisional application No. 61/440,172, filed on Feb. 7, 2011.

(51) Int. Cl.
*B65D 85/14* (2006.01)

(52) U.S. Cl.
USPC ..... 206/277; 206/372; 206/446

(58) Field of Classification Search
USPC ..... 206/69, 373, 384, 372, 499, 277, 206/443, 446, 81, 447, 445, 349, 815; 220/737, 220/529, 23.87
See application file for complete search history.

(56) References Cited

U.S. PATENT DOCUMENTS

| | | | | | |
|---|---|---|---|---|---|
| 2,740,546 | A * | 4/1956 | Kowalski | 220/23.88 |
| 3,034,517 | A * | 5/1962 | Reiland | 453/29 |
| 4,039,288 | A * | 8/1977 | Moran | 422/65 |
| 4,114,196 | A * | 9/1978 | Lostutter | 366/348 |
| 4,362,243 | A * | 12/1982 | Deyesso et al. | 206/373 |
| 5,092,463 | A * | 3/1992 | Dees | 206/373 |
| 5,350,065 | A * | 9/1994 | Darrey | 206/373 |
| 5,375,716 | A * | 12/1994 | Rubin et al. | 206/443 |
| 5,871,106 | A * | 2/1999 | Oksa et al. | 211/70.6 |
| 5,971,333 | A * | 10/1999 | Fiedor | 248/129 |
| 6,919,096 | B2 * | 7/2005 | Selk | 426/104 |
| 7,159,735 | B2 * | 1/2007 | Morse | 220/529 |
| 7,305,793 | B1 * | 12/2007 | Macdonald | 43/54.1 |
| 2005/0189250 | A1 * | 9/2005 | Hsu | 206/373 |

* cited by examiner

*Primary Examiner* — Jacob K Ackun
*Assistant Examiner* — Jenine Pagan
(74) *Attorney, Agent, or Firm* — Polster, Lieder, Woodruff & Lucchesi, L.C.

(57) ABSTRACT

A caulk carrying device includes a plurality of cylindrical compartments for holding tubes of caulk and for holding a caulk dispensing gun. Preferably, of a durable material, the device may be used as an insert or as a free-standing carrier.

9 Claims, 5 Drawing Sheets

CAULK "BUDDY" ORGANIZER CADDY

PRIORITY CLAIM

This application claims the benefit of U.S. Prov. App. No. 61/440,172, filed Feb. 7, 2011, which is hereby incorporated by reference.

FIELD OF THE INVENTION

The invention relates generally to devices to carry tubes of caulk, adhesive, etc. and related accessories (such as caulk "guns").

BACKGROUND OF THE INVENTION

At many building construction sites as well as other settings, there is a significant need for caulks, silicones and adhesives. These products are typically sold in tubes, some of which are cardboard. Many projects require the use of more than one type of caulk, silicone or adhesive. The amount needed can be difficult to carry from one place to another on the project site, may be easily damaged and are not easily removed once contact is made with (i.e., if inadvertently dispensed on or applied to) unintended surfaces.

Various caulks, silicones, adhesives and other like compounds are used in carpentry, construction and painting professions. Some projects require 4 to 5 different types of caulks, silicones or adhesives to complete a project. For example, bathroom projects require as many as 5 different varieties of these products, each one of which is used for a different application in a bathroom. The most common types of such products are rubber types such as clear or white rubber silicone, adhesives like Liquid Nail®, clear and white acrylics that come in paintable or non-paintable varieties. A worker or amateur "do-it-yourself" can have a number of different tubes of caulk on hand for simple bathroom jobs. The tubes for these products are generally heavy on one end and light on the other. Because of the weight imbalance, dropping and damaging tubes is common.

Some caulks, silicones, and adhesives are sold in disposable cardboard containers. For example, Liquid Nail® brand adhesive, other caulk compounds, window glazing products, roof flashing adhesives and concrete crack fill are sold in either disposable cardboard tubes or disposable plastic tubes. Most tubes are carried in a box or loose in a bucket. Busy workers often toss heavy hammers and pipe wrenches in a bucket and damage unprotected tubes. Tubes stored in a cardboard box are dropped and often damaged as a result of rough handling and dropping due to box sides splitting Caulk, silicone and adhesive nozzle tips are cut on an angle to facilitate the ability for visual preciseness when applying. When use of a caulk tube, for example, is done, some caulk tends to seep or ooze from the nozzle, and then harden because the angle-cut tips cannot be closed completely. Often, nail or screw insertions are used as closures by many workers. Again, because of the necessary angle of the cut, these methods are usually, ineffective.

SUMMARY OF THE INVENTION

The preferred caulk carrier or caddy comprises a portable container for transporting and storing multiple tubes of commercially available caulk, adhesive, etc. The carrier addresses this problem for the construction trade because of its design and perfect fit as an insert into a durable, five (5) gallon plastic bucket, which is a common staple for construction sites and painters, alike. Such buckets are airtight when lidded and prolong the life and usability of caulks, silicones, adhesives, window glazes and roof flashing compounds.

Also considered is the potential for work environment hazards to workers. Without proper upright storage for caulk and adhesives tubes, the tubes are easily toppled and roll. Engaged workers carrying other construction or painting materials may have an obstructed view of the potential hazard of slipping, tripping and falling on loose tubes.

The preferred carrier is made of a durable material. It has a plurality of adjoining but separate cylindrical receptacles, each of which is sized to accommodate a tube of caulk, silicone, or adhesive product. The carrier includes a center cylindrical cavity or receptacle sized to hold a standard-size caulk "gun" dispenser. The carrier is one-piece and stackable. It has a plurality of finger-shaped holes in a top surface to facilitate lifting of the carrier out of a bucket when used as an insert or to facilitate carrying the carrier when it is used as a free-standing carrier.

DESCRIPTION OF DRAWINGS

In the accompanying drawings, in which one of various possible embodiments of the invention is illustrated, corresponding reference characters refer to corresponding parts throughout the several views of the drawings in which.

DESCRIPTION OF THE PREFERRED EMBODIMENT

Figure 2:
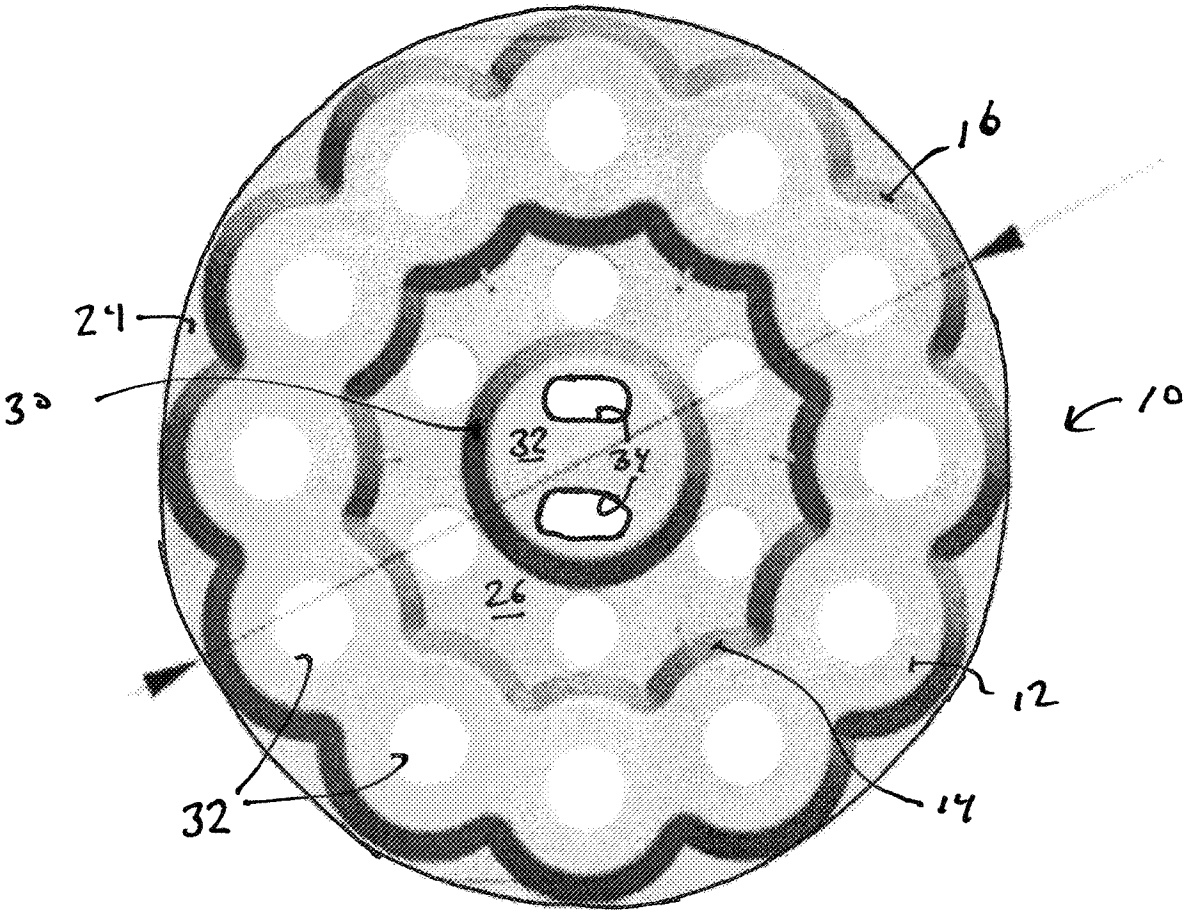
FIG. 2 is a bottom plan view of the carrier.
Figure 3:
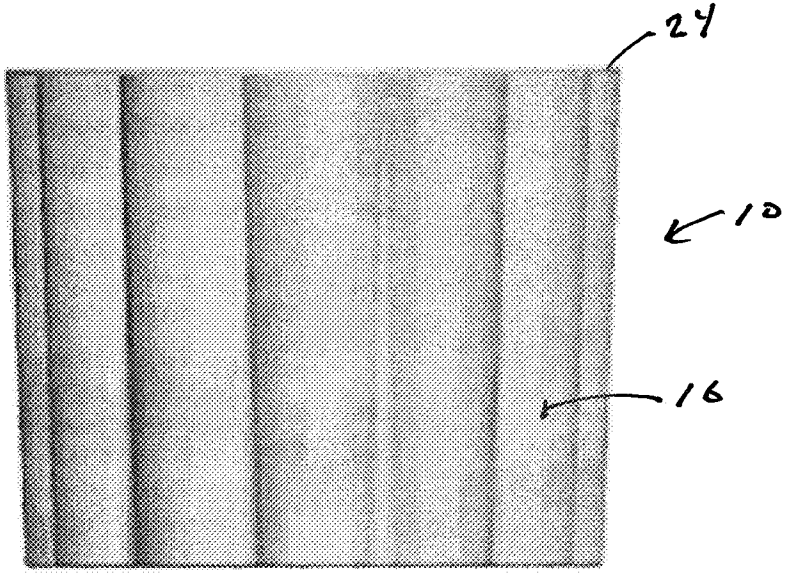
FIG. 3 is a side elevational view of the carrier.
Figure 4:
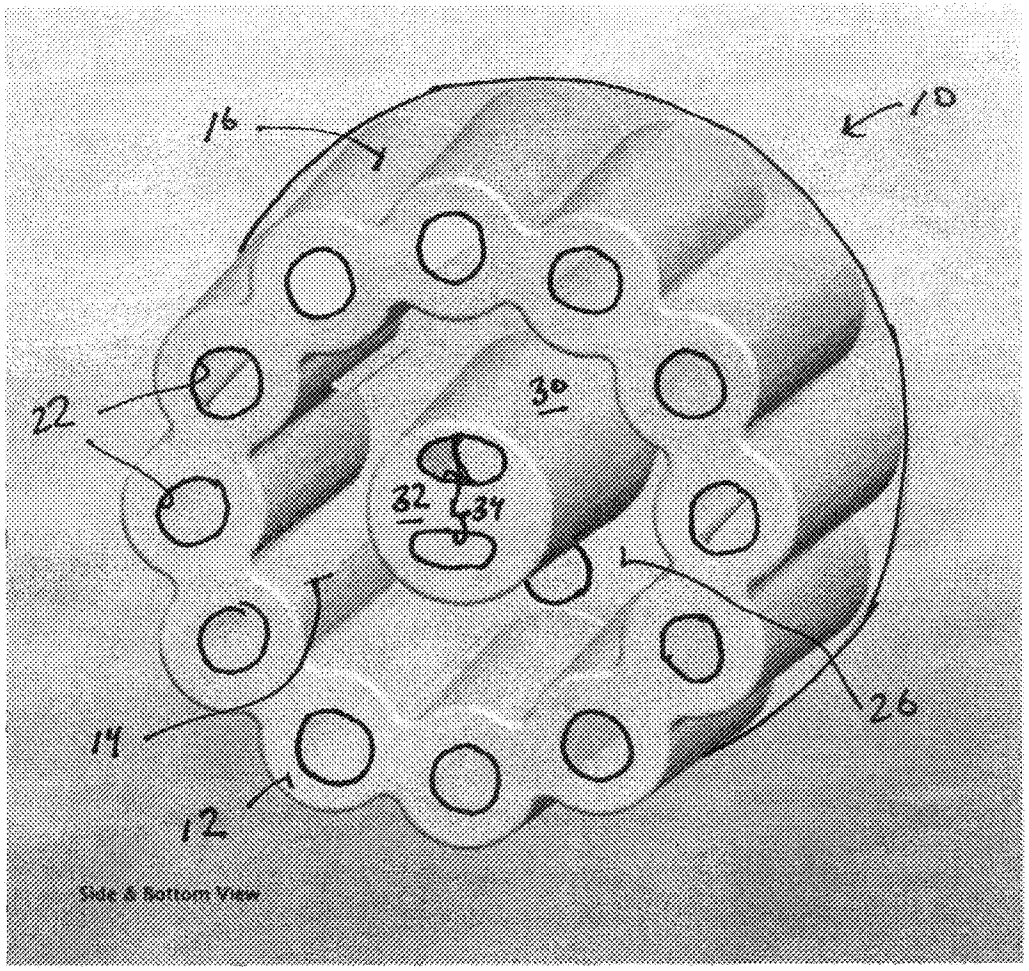
FIG. 4 is a bottom perspective view of the carrier.

A preferred embodiment of a caulk tube carrier or caddy 10 comprises a one-piece cylindrical unit made of a durable material, such as a thermoplastic. The carrier 10 has a generally annular bottom surface 12. A middle wall 14 and an outer wall 16 extend upwardly from the inner and outer edges, respectively, of the annular bottom surface 12. The middle wall 14 and outer wall 16 are generally coaxial with each other, and each wall is generally cylindrical. Although, as seen in FIG. 2, the middle and outer walls both slope slightly, such that the middle and outer walls are closer to each other at their bottoms than at their tops. The outer surface 14*a* of the middle wall 14 defines a plurality of inner scallops 14*b*; and the inner surface 16*a* of the outer wall 16 defines a plurality of outer scallops 16*b*. The scallops extend around the middle and outer walls such that the scallops are adjacent each other. That is, the right end or edge of one scallop defines the left end or edge of the adjacent scallop. As seen in the drawings (especially, FIG. 5), the walls are of substantially constant width. Hence, the outer surface of the outer wall 16 and the inner surface of the middle wall 14 also defines scallops. At the top of the outer wall 16, the device 10 includes a lip 24 which extends outwardly from the outer wall. The lip 24 has a circumferential edge which defines a circle. The carrier 10 is sized such that it can be received as an insert in, for example, a conventional 5-gallon bucket.

The inner scallops 14*b* and outer scallops 16*b* each define an arc. The inner scallops 14*b* and outer scallops 16*b* are aligned, such that each inner scallop faces an outer scallop.

Further, the radius of the inner and outer scallops is substantially the same, such that each pair of opposed scallops defines a generally tube receiving receptacle 18 that is generally circular in plan. As noted above, the middle and outer walls slope toward each other from top to bottom. Hence, the tube receiving receptacles 18 are tapered, and decrease in effective circumference from top to bottom.

Figure 1:
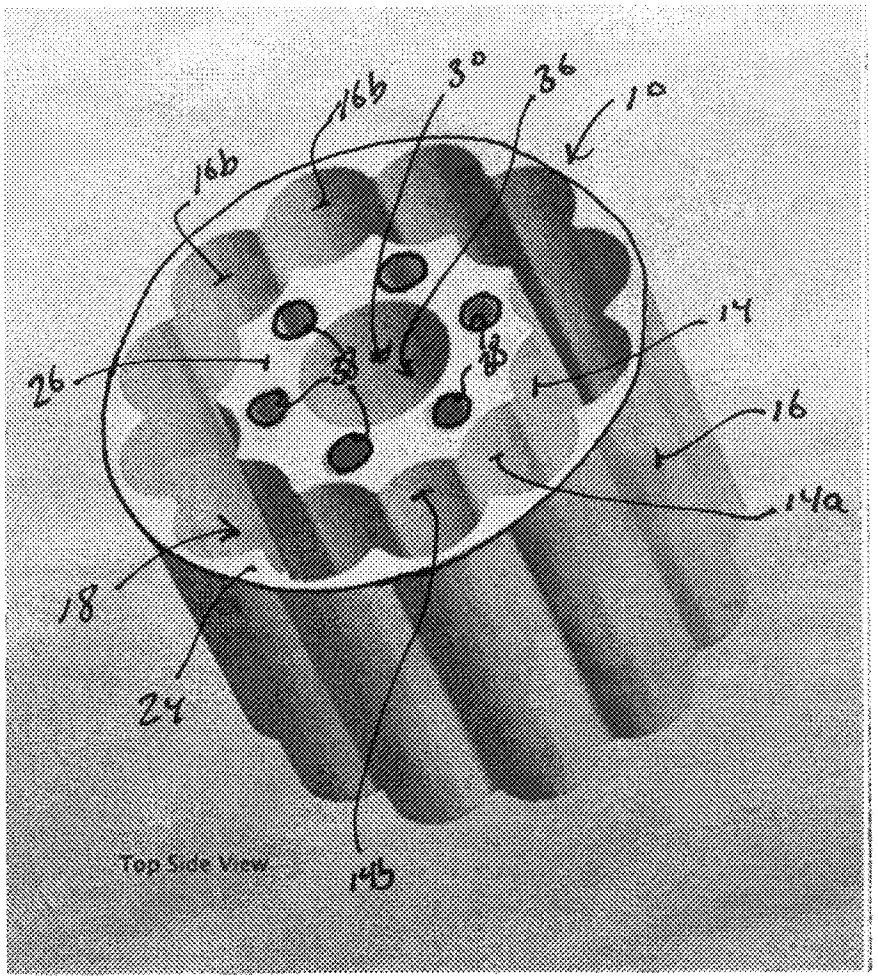
FIG. 1 is a perspective top view of an illustrative caulk tube carrier.
Figure 6:
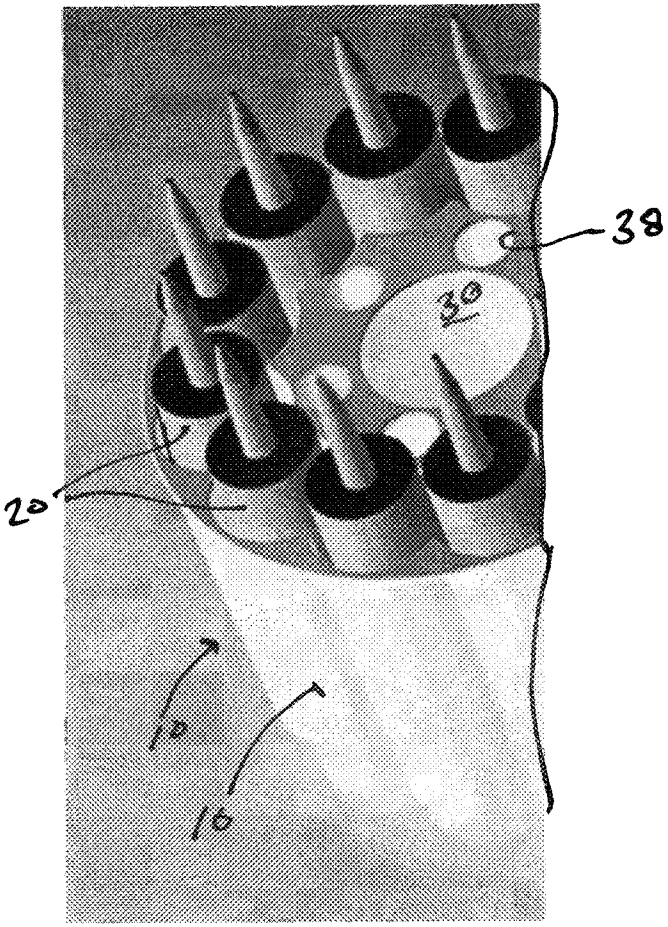
FIG. 6 is a fragmentary perspective view of the carrier when loaded with caulk tubes.

Further, as seen in FIG. 1, each tube receiving receptacle opens to the two neighboring tube receiving receptacles. Thus, the tube receiving receptacles are adjoining or communicating receptacles. That is, each receptacles is adjoining to or communicating with its two adjacent receptacles. The carrier 10 is shown in the drawings to have twelve tube receiving receptacles 18. Each tube receiving receptacle 18 is sized to receive an upright tube 20 of caulk or the like, as seen in FIG. 6. The annular bottom surface 12 defines a bottom for the tube receiving receptacles 18, and each receptacle 18 has a hole 22 in the bottom 12. As best seen in FIG. 2, the holes 22 are approximately centered relative to the receptacles 18.

Figure 5:
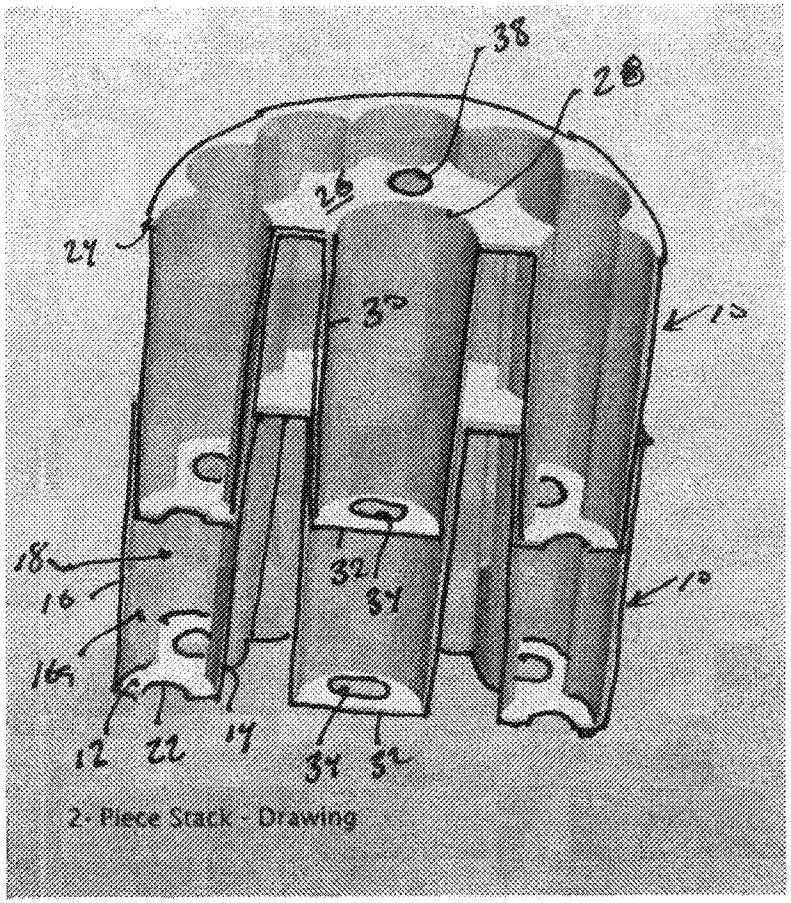
FIG. 5 is a cross-sectional view showing two of the carriers when stacked.

An upper surface 26 extends inwardly from the middle wall 14. An opening 28 (shown to be generally circular) is formed in the approximate center of the upper surface 26. An inner wall 30 extends downwardly from the edge of the opening 28 to a central bottom surface 32. The inner wall 30 is shown to be generally concentric with the middle wall 14 and outer wall 16. Two openings 34 (shown to be oval) are formed in the central bottom surface 32. The inner wall 30 and bottom surface 32 define a larger cylindrical cavity or receptacle 36 centered relative to the carrier 10 to hold or store a caulk dispensing gun. The inner wall 30, like the middle and outer walls, is shown to be tapered. This taper of the walls is best seen in FIGS. 2 and 5. Thus, the receptacle 36 tapers from a larger diameter at the top surface 26 to a smaller diameter at its bottom surface 32.

As seen best in FIG. 5, the outer, middle, and inner walls are of approximately the same height, and thus, the receptacle 36 and tube receiving receptacles 18 have approximately the same depth. The taper of the walls allows for the carrier to be received within a bucket as an insert. The tapered walls also allow multiple carriers 10 to be stacked as seen in FIG. 5. Additionally, because the central bottom surface 32 is not below the annular bottom surface 12, the carrier 10 can used as a free-standing carrier.

The upper surface 26 further includes a plurality of openings 38 (six openings are shown) which surround the receptacle 36. The openings 38 are finger-sized to facilitate lifting and carrying of the device 10, for example when the carrier is being used as a stand-alone carrier.

The caulk carrier 10 can be used as a portable container for transporting and storing multiple tubes of commercially available caulk. The preferred embodiment addresses the problem of ease of portability as well as limiting loss due to damaged tubes for the construction trade because of its design and perfect fit as an insert into a standard or common durable five (5) gallon plastic bucket, which is a common staple for construction sites and painters, alike. Such buckets are airtight when lidded and prolong the life and usability of caulks, silicones, adhesives, window glazes and roof flashing compounds.

Ordinary tubes of caulk or the like, such as found in hardware stores, are designed to be disposable and are about 2 inches in diameter and about 9 inches long not counting the nozzle. The cylindrical hollow body is formed from cardboard or plastic and can be dented or broken by rough handling. Protection of caulk tubes is important because if the hollow body is dented or otherwise damaged, the piston of the dispensing "gun" may not slide down the bore or body of the tube rendering the caulk tube useless.

In the preferred embodiment, the carrier is designed to hold a plurality of tubes of caulk or the like. The simplicity of the carrier, as shown in the drawings, represents a best mode for organizing, safely storing and transporting tubes of caulk, silicone or adhesive materials from workplace to workplace without significant risk that the tubes will be dented or otherwise damaged and rendered useless.

The preferred embodiment of the carrier is easy to use and effectively addresses the problems of storing, transporting and organizing various caulk and adhesives. The larger centered cylindrical cavity creates a home for the caulk dispensing gun.

The preferred embodiment of the carrier is used as an insert for a five (5) gallon plastic bucket, as such is common to most construction sites and most professional painters. The preferred embodiment of the carrier offers protection from unintended loss, and also helps to achieve easy identification of type variations of caulk, silicones and adhesives which may include different colors and "paint over" types. With bucket consideration, the situated depth of the preferred embodiment makes it possible to "lid" the bucket and create an airtight seal, thus prolonging the use of the unused caulk, silicones and adhesives affected by hardening if the tubes are not sealed adequately after they have been opened.

The preferred embodiment of the carrier is made of a durable material. Thermoplastics such as polyethylene, polypropylene and other similar thermoplastic materials are acceptable choices as durable materials, although other materials are suitable. Members of this family are recognized universally as being versatile and of high quality. The benefits of using thermoplastic materials are that they have a wide range of qualities. They may be extremely durable, rigid, or flexible, opaque or transparent, resistant to heat or chemicals and unyielding or springy. The invention is not limited to material choices for the carrier, and may also be constructed from wood, metal or other materials.

In view of the fact that the carrier is made from a rigid durable material, the carrier serves as a protective housing for ordinary caulk tubes such as found in hardware stores are designed to be disposable and are about 2 inches in diameter and about 9 inches long not counting nozzle. Cylindrical hollow tubes are formed from cardboard, plastic or the like and can be dented by rough handling. Protection of caulk tubes is important because if hollow body is dented or otherwise damaged, piston may not slide down the tube bore rendering the caulk tube useless.

The carrier is easy to use and effectively addresses the problems of containing, storing, organizing types and safely transporting caulks and adhesives from place to place. The larger centered cylindrical cavity creates a home for the caulk and or adhesive dispensing gun, helping to safeguard and therefore, diminish a potential for a physical work hazard.

The preferred embodiment of the carrier is not limited to the properties as an insert, only. The design incorporates the necessary features of a free-standing device with a cylindrical unit comprised of a plurality of cylindrical compartments or receptacles which are adjoined but distinctly separate to contain a plurality of tubes of caulk, silicone or adhesive and makes possible the process of identifying the type of caulk, silicones or adhesive contained in the receptacle easy and at a glance. The carrier 10 is seen to provide a good carrying and storage solution for the amateur or "do-it-yourself" types.

In view of the above, it will be seen that the invention achieves an advantageous result. As various changes could be made in the above constructions without departing from the scope of the invention, it is intended that all matter contained in the above description or shown in the accompanying drawings shall be interpreted as illustrative but not in a limiting sense.

While the preferred embodiment of the invention has been illustrated and described, as noted above, changes can be made without departing from the spirit and scope of the invention. Accordingly, the scope of the invention is not limited by the disclosure of the preferred embodiment.

The invention claimed is:

1. A caulk tube caddy comprising:

a bottom surface;

a first generally circular wall extending upwardly from said bottom surface and having an inner surface and an outer surface; the inner surface of the first wall defining a plurality of scallops, wherein the scallops are adjacent each other;

a second wall generally circular wall extending upwardly from said bottom surface; said second wall being concentric with the first wall, positioned within the first wall, and having a height substantially equal to a height of said first wall; the second wall having an inner surface and an outer surface; the outer surface of the second wall defining a plurality of adjacent scallops;

each of said scallops of said second wall facing and being aligned with a scallop of said first wall; said scallops of said first and second walls defining a radius; the radius of said scallops of said first and second walls being substantially identical, whereby each pair of facing scallops defines an elongate outer receptacle that is generally circular in plan and which is open along opposed sides of the outer receptacle such that adjacent outer receptacles are in communication with each other; and a top surface extending inwardly from said second wall; said top surface defining a generally circular opening; said caulk caddy further including a generally circular third wall extending downwardly from an edge of said opening of said top surface; said third wall being generally concentric with, and positioned inside of, said second wall.

2. The caulk caddy of claim 1 wherein said bottom surface defines a bottom for each receptacle; said bottom surface defining an opening at the bottom of each receptacle.

3. The caulk caddy of claim 1 wherein said bottom surface defines an annular surface; said caulk caddy further including a center bottom surface at the bottom of said third wall; said third wall and center bottom surface defining a center receptacle.

4. The caulk caddy of claim 3 wherein said third wall has a height substantially equal to the height of said first and second walls; whereby said center receptacle has a depth substantially equal to the depth of said outer receptacles.

5. The caulk caddy of claim 1 including a plurality of finger holes in said top surface.

6. The caulk caddy of claim 1 wherein at least said first wall is of a generally constant thickness; whereby said outer surface of said first wall is convexly scalloped.

7. The caulk caddy of claim 6 further including a lip extending outwardly from a top edge of said outer surface.

8. The caulk caddy of claim 1 further including a lip extending outwardly from a top edge of said first wall.

9. The caulk tube caddy of claim 3 wherein the first and second walls slope toward each other, such that the outer receptacles are tapered; and wherein the third wall is sloped such that the center receptacle is tapered; whereby, a plurality of the caulk tube caddies can be stacked.

* * * * *